United States Patent [19]

Spear et al.

[11] Patent Number: 5,007,598

[45] Date of Patent: Apr. 16, 1991

[54] HOSE REEL ASSEMBLY

[75] Inventors: Kenneth J. Spear, Vienna, W. Va.; Ronald R. Fowler, Coolville, Ohio

[73] Assignee: O. Ames Co., Parkersburg, W. Va.

[21] Appl. No.: 426,212

[22] Filed: Oct. 25, 1989

[51] Int. Cl.[5] ..... B65H 75/34

[52] U.S. Cl. ..... 242/86.2; 242/86; 242/115; 242/116; 242/118.4; 137/355.27

[58] Field of Search ..... 242/86, 86.1, 86.2, 242/86.5 R, 115, 116, 117, 118.4, 118.6, 77, 77.3; 137/355.12, 355.16, 355.19, 355.2, 355.26, 355.27

[56] References Cited

U.S. PATENT DOCUMENTS

| | | | |
|---|---|---|---|
| 2,488,425 | 11/1949 | Morrone . | |
| 2,512,756 | 6/1950 | Wasserman . | |
| 2,590,963 | 4/1952 | Hannay . | |
| 3,940,085 | 2/1976 | Campbell | 242/115 |
| 4,137,939 | 2/1979 | Chow . | |
| 4,512,361 | 4/1985 | Tisbo et al. | 242/86 X |
| 4,768,546 | 9/1988 | Brusadin et al. . | |
| 4,777,976 | 10/1988 | Johnston et al. . | |

OTHER PUBLICATIONS

"Sears Assembly Instructions for Curb Service Refuse Carts", date unknown.

*Primary Examiner*—Stuart S. Levy
*Assistant Examiner*—Steven M. duBois
*Attorney, Agent, or Firm*—Cushman, Darby & Cushman

[57] ABSTRACT

A portable hose reel assembly comprising a wheeled frame structure rotatably supporting a hose reel structure by a shaft assembly communicating water under pressure to a hose to be wound on the hose reel structure. The frame structure comprises a pair of molded plastic three-cornered side frames and four blow molded plastic members rigidly interconnected therebetween by grooved ends snapped into tabbed sockets. The hose reel structure comprises a pair of reel end structures having integral hub portions and two semicylindrical hub parts movable in opposed radial directions into an operative position with respect to the hub portions in hose coil load transmitting relation to one another. The end walls of the hub portions and the ends of the hub parts include integral interengaging elements which serve to retain the reel and structures and hub parts in operative position when moved therein.

40 Claims, 8 Drawing Sheets

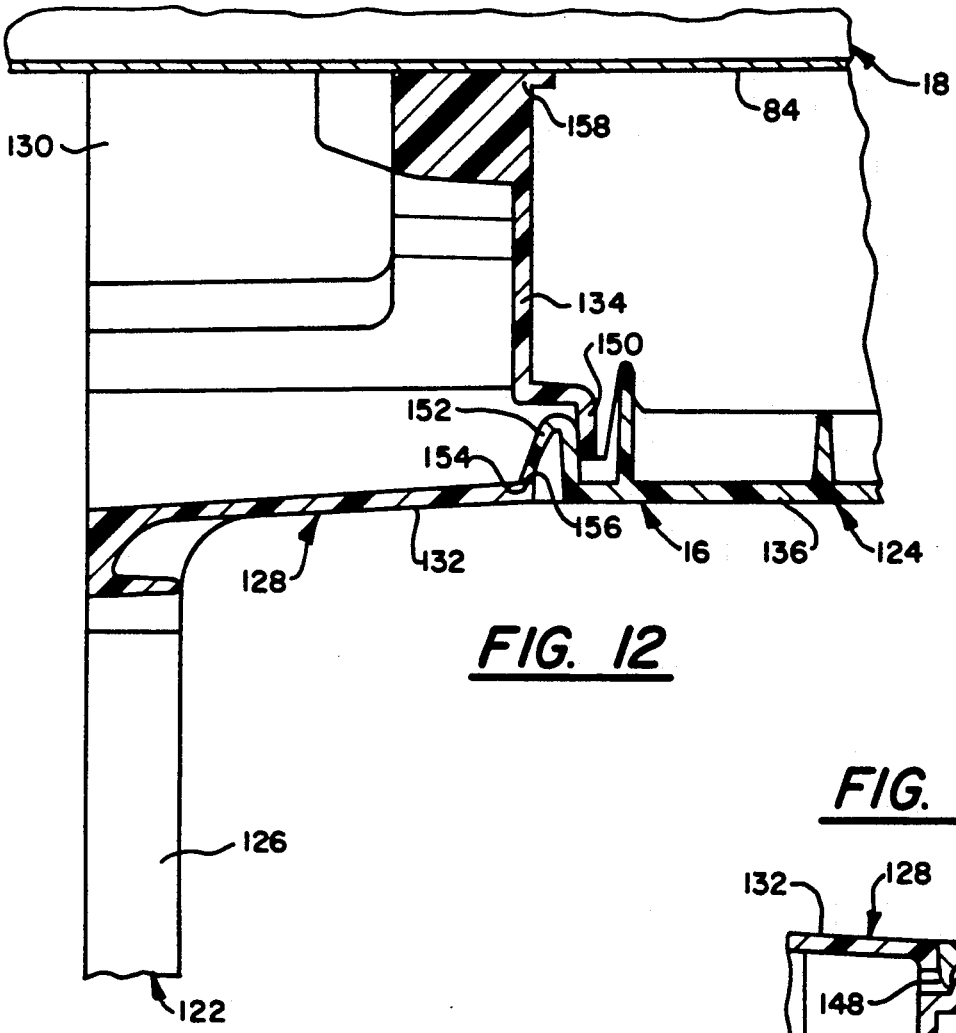
FIG. 12
FIG. 13
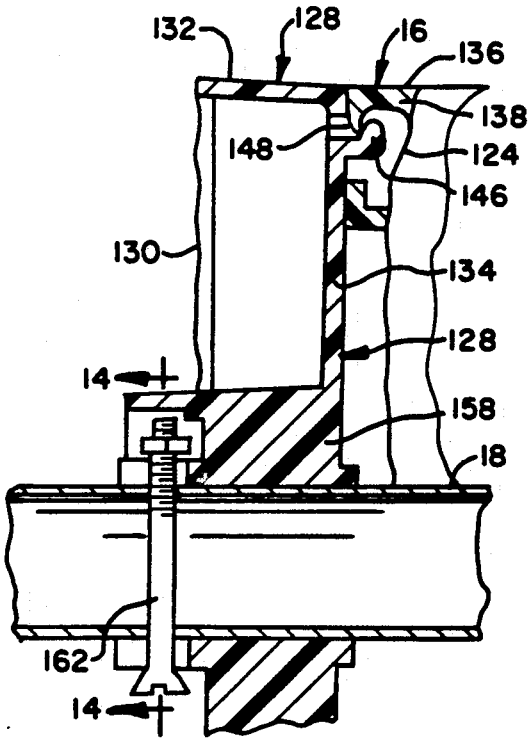
FIG. 14
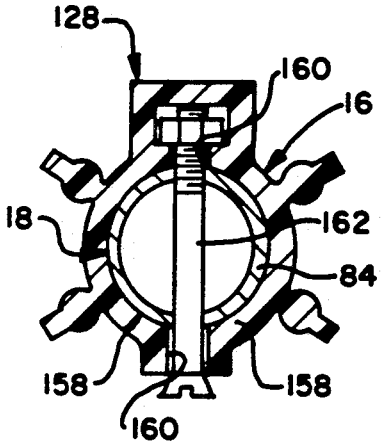

HOSE REEL ASSEMBLY

This invention relates to hose reels and more particularly to hose reels of the portable type.

Portable hose reels have been commercially available for many years. The earlier versions embodied a metal tubular frame structure movably supported on a pair of wheels rotatable on an axle mounted on the frame structure and a hose reel rotatably mounted on the frame structure. Examples of portable hose reels of the metal tubular frame type are disclosed in the following U.S. Pat. Nos.: 2,488,425, 2,512,756, 2,590,963, and 4,137,939.

In recent years, efforts have been made to replace the metal tubular frame structure with a frame structure constructed of frame members formed of plastic material. In general, the plastic frame structures have utilized a pair of molded plastic side frame members and a plurality of transversely extending plastic frame members suitably secured between the side frame members. It is a basic characteristic of all of the plastic frame structures that the various plastic frame members should be packaged for sale in separated condition for assembly by the purchaser. Consequently, simplicity of assembly is an element of cost effectiveness with respect to plastic frame structures. Other elements of cost effectiveness include maximizing frame strength and rigidity with a minimum use of material and an effective use of simplistic frame member securement techniques. There is always a need to improve cost effectiveness in the provision of such portable hose reel assemblies.

Accordingly, it is an object of the present invention to fulfill the aforesaid need by providing a cost effective portable hose reel assembly. In accordance with the principles of the present invention, this objective is obtained by providing a portable hose reel assembly which comprises a pair of molded plastic side frames each of similar generally triangular shaped configuration providing three corner structures. The pair of side frames are disposed in transversely spaced parallel relation with corresponding corner structures facing one another. A first of the three corner structures of each side frame has a first socket therein opening in a direction toward the corresponding corner structure. A second of the three corner structures of each side frame has a second socket therein opening in a direction toward the corresponding corner structure. A plurality of transverse frame members each formed of plastic by blow molding so as to define an elongated hollow tubular central portion having closed end portions on opposite ends of the central portion. The closed end portions of the transverse frame members are shaped to respectively fit snugly within the first and second sockets. Each closed end portion and the associated socket has interengaging surfaces operable in response to the transverse movement of the closed end portion into the associated socket to retain the closed end portion against transverse movement out of the associated socket so that when all of the closed end portions are retained in snugly fitting relation with the associated sockets. The transverse frame members and the side frames constitute a hose reel supporting frame structure. A third of the three corner structures of the side frames have aligned shaft receiving openings therein and a shaft extends through the shaft receiving openings and has supporting wheels thereon for enabling the hose reel supporting frame structure to be rollingly supported for manual movement along a generally horizontally extending surface by an operator grasping a central portion of a transverse frame member associated with the first sockets. The second corner structures provide means for engaging a generally horizontally extending surface on which the supporting wheels are engaged for stably fixedly supporting the hose reel supporting frame structure on the generally horizontally extending surface. A hose reel structure for receiving a length of hose in coiled formation thereon is rotatably supported between the side frames in a position such that the hose reel structure is disposed above a generally horizontally extending surface on which the hose reel supporting frame structure is manually moved or stably fixedly supported as aforesaid. The hose reel supporting frame structure thus provided presents an optimum strength characteristic for the amount of plastic material utilized by virtue of the three corner configuration of the side frames, the utilization of hollow closed ended blow molded transverse frame members, the snugly fitted hollow closed ends within the side frame sockets and the push in securement of the snugly fitted hollow closed ends within the sockets without the need for extraneous fasteners.

Another area where a cost effective plastic material construction is needed is in the hose reel construction itself. Here again, simplicity of assembly is desirable as is maximizing strength characteristics while minimizing material utilization. Many of the existing hose reels are simply not designed to withstand the peripheral squeezing forces which can be transmitted to a hose reel when the hose is communicated with a source of water under pressure while still wound around the reel and the free end of the hose is shut off as by a closed nozzle or the like. Where a contained pressure situation is inadvertently allowed to come into existence with respect to a hose reel which is not designed for such pressure, structural failure can rapidly occur. The question of providing sufficient strength on a cost effective basis is particularly acute in large capacity reels. In one commercially available unit, the hose reel consists of two reel halves (i.e. divided in the middle along a radial plane) that can be directly connected together by fasteners for a small capacity unit (see also U.S. Pat. Nos. 4,768,546 and 4,777,976) or, where a larger capacity unit is desired, the two reel halves can be directly connected together by a pair of intervening short annular spacers suitably secured by fasteners together and to the reel halves. Another hose reel construction presently available commercially utilizes separate hose reel ends and three separate hub pieces each of which is separately secured in a spaced operative position between the hose reel ends by push in connectors thus avoiding the necessity of providing separate fasteners to effect assembly. There is always the need to provide an easily assembled hose reel structure which does not require extraneous fasteners and which is cost effective from a strength and material usage point of view to an extent sufficient to withstand a contained water pressure situation.

Another object of the present invention is to fulfill the need for such a cost effective hose reel. In accordance with the principles of the present invention, this objective is obtained by providing a hose reel assembly comprising a first reel end structure having a central axis and a fixed first hub portion extending axially therefrom, a second reel end structure having a central axis aligned with the axis of the first reel end structure, the second reel end structure has a fixed second hub portion extending axially therefrom in a direction toward the first hub portion in axially aligned and axially spaced relation thereto. A plurality of cooperating hub parts, each having axially spaced first and second end portions, have connectors cooperating with mating connectors on the first and second hub portions of the first and second reel end structures for enabling each hub part to be secured in an operative position in fixed relation between the hub portions in response to a generally radially inward movement of the hub part with respect to the hub portions of the reel end structures. The hub portions have axially extending exterior hose engaging surfaces and the hub parts when in their operative positions with respect to the hub portions provide axially extending exterior hose engaging surfaces extending between the exterior hose engaging surfaces of the hub portions between the reel end structures around which a length of hose can be coiled between the reel end structures. The hub parts have interengaging surfaces disposed in compressive hose coil load transmitting relation with respect to one another when the hub parts are in their operative positions. With this construction, the hub portions formed integrally part with the reel end structures provide annular integrity at the ends of the hub and the interengaging surfaces in hose coil load transmitting relation provide annular integrity in the central area of the hub.

These and other objects of the present invention will become more apparent during the course of the following detailed description and appended claims.

The invention may best be understood with reference to the accompanying drawings wherein an illustrative embodiment is shown.

IN THE DRAWINGS

FIG. 12 is an enlarged fragmentary sectional view take along the line 12—12 of FIG. 2;

FIG. 13 is an enlarged fragmentary sectional view taken along the line 13—13 of FIG. 2; and FIG. 14 is a fragmentary sectional view taken along the line 14—14 of FIG. 13.

Figure 1:
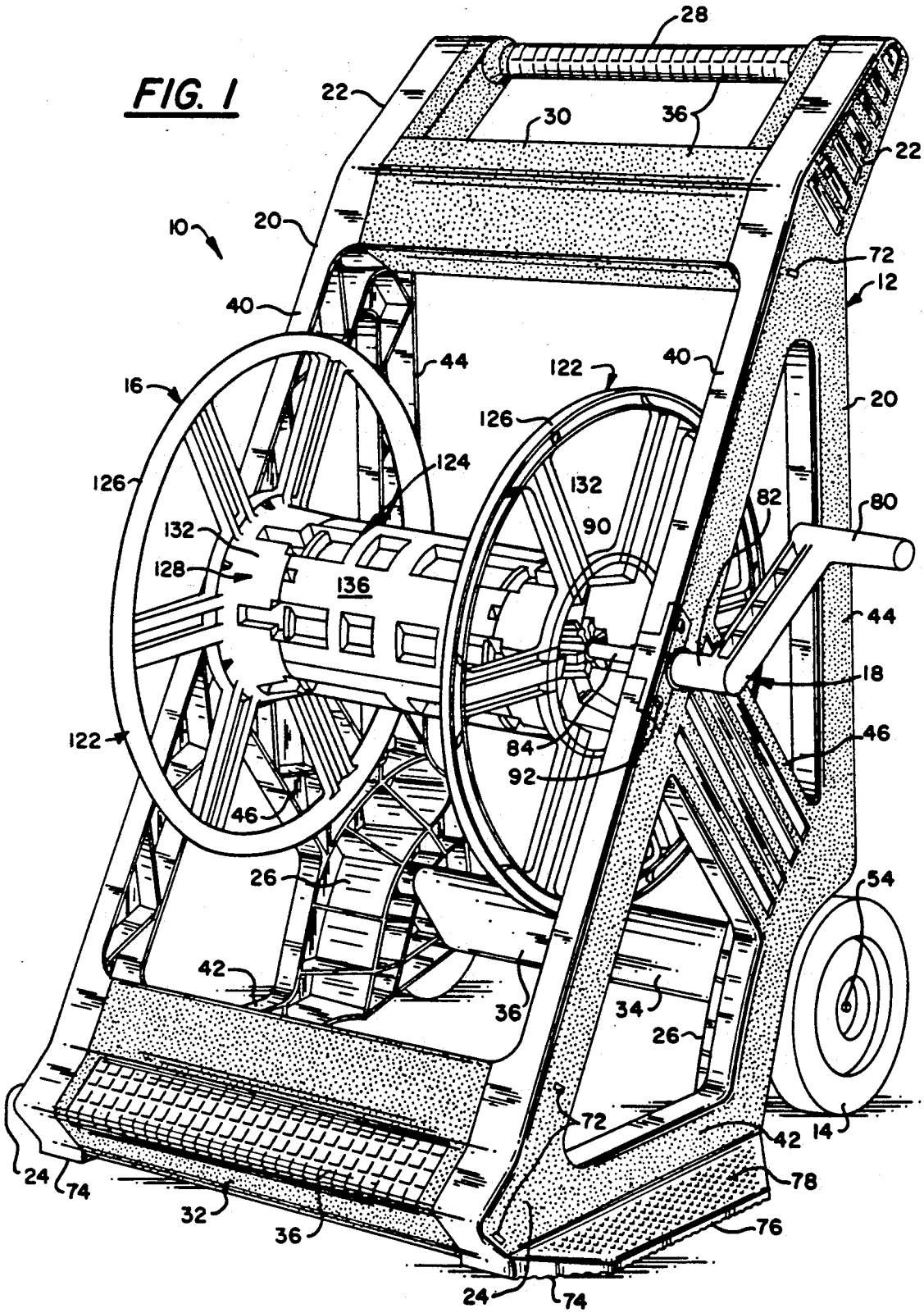
FIG. 1 is a perspective view of a portable hose reel assembly embodying the principles of the present invention.

Referring now more particularly to the drawings, there is shown in FIGS. 1–4 thereof a portable hose reel assembly, generally indicated at 10, embodying the principles of the present invention. The assembly 10 includes a hose reel supporting frame structure, generally indicated at 12, having a pair of wheels 14 by which the hose reel supporting frame structure 12 may be moved in portable fashion along the ground. A hose reel structure, generally indicated at 16, is rotatably mounted on the hose reel supporting frame structure 12 by a shaft assembly, generally indicated at 18.

The hose reel supporting frame structure 12, as shown, includes a pair of molded plastic side frames 20 each of similar generally triangular shaped configuration of mirror image relation with respect to one another providing first, second, and third corner structures 22, 24, and 26. The two side frames 20 are fixedly interconnected by upper and lower first transverse frame members 28 and 30, a second transverse frame member 32, and a third transverse frame member 34. All of the transverse frame members are preferably formed of a suitable plastic by blow molding so as to define an elongated hollow tubular central portion 36 having closed end portions 38 on opposite ends of the central portion.

The side frames 20 are complementary to one another and each includes a forward elongated frame portion 40 extending downwardly and forwardly from the first corner structure 22 thereof to the second corner structure 24. A lower elongated frame portion 42 extends generally horizontally rearwardly from the second corner structure 24 to the third corner structure 26. Extending generally vertically upwardly from the third corner structure 26 to the first corner structure 22 is a rearward elongated frame portion 44. Finally, an elongated diagonal frame portion 46 extends generally downwardly and rearwardly from the center of the forward frame portion 40 to the rearward frame portion 44. Each of the elongated frame portions 40, 42 and 44, as well as the diagonal frame portion 46, is of generally channel-shaped configuration having strengthening ribs in the interior thereof as can be seen from FIG. 1. The channel-shaped configurations of the two side frames 20 open toward one another.

Figure 2:
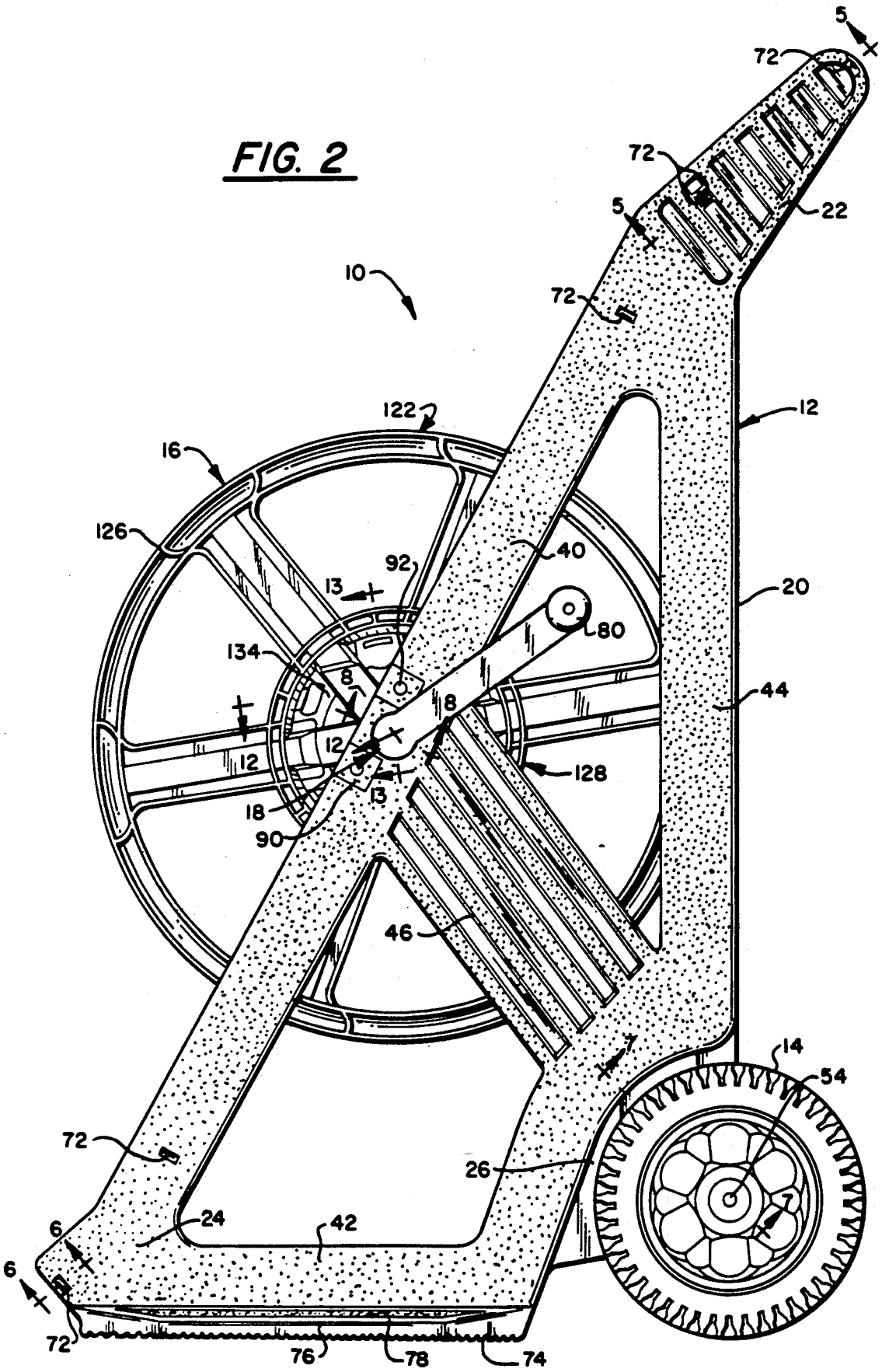
FIG. 2 is a right side elevational view of the portable hose reel assembly.
Figure 3:
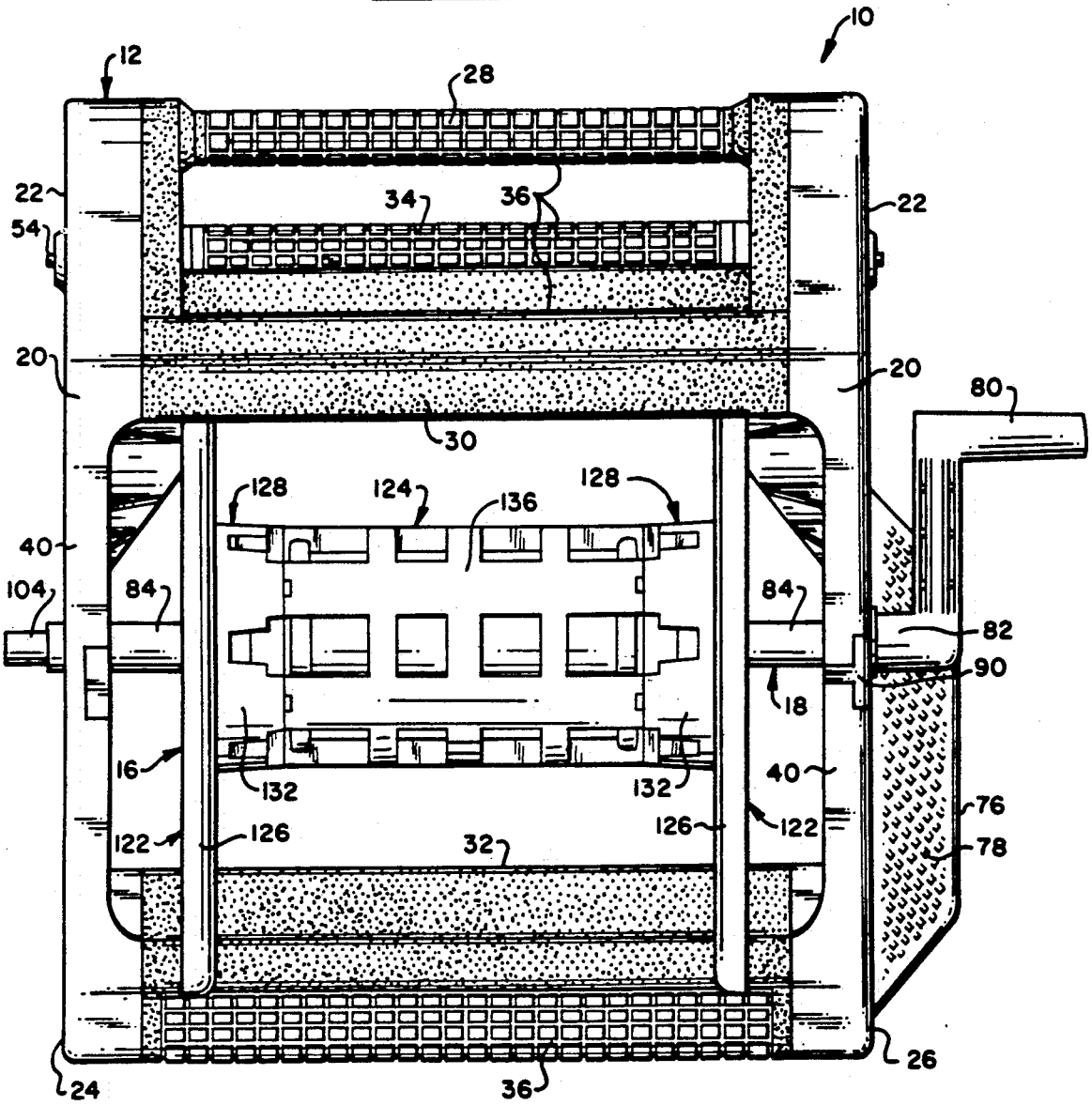
FIG. 3 is a top plan view of the portable hose reel assembly.
Figure 5:
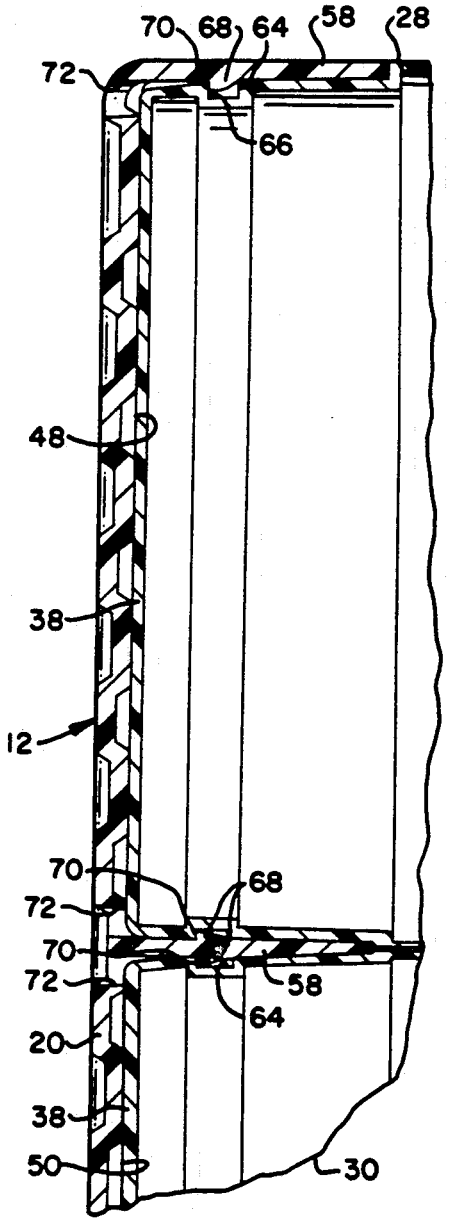
FIG. 5 is an enlarged fragmentary sectional view taken along the line 5—5 of FIG. 2.

As best shown in FIGS. 1, 2 and 5, the first corner structure 22 of each side frame 20 includes the juncture between the associated forward and rearward elongated frame portions 40 and 44 and upper and lower first sockets 48 and 50 shaped to snugly fit and receive a closed end portion 38 of the associated upper and lower first transverse frame members 28 and 30 respectively.

Figure 6:
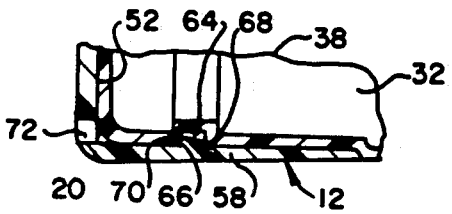
FIG. 6 is an enlarged fragmentary sectional view taken along the line 6—6 of FIG. 2.

As best shown in FIGS. 1, 2, and 6, the second corner structure 24 of each side frame 20 includes the juncture between the adjacent forward and lower elongated frame portions 40 and 42 and a second socket 52 shaped to snugly fit and receive a closed end 38 of the associated second transverse frame member 32.

Figure 4:
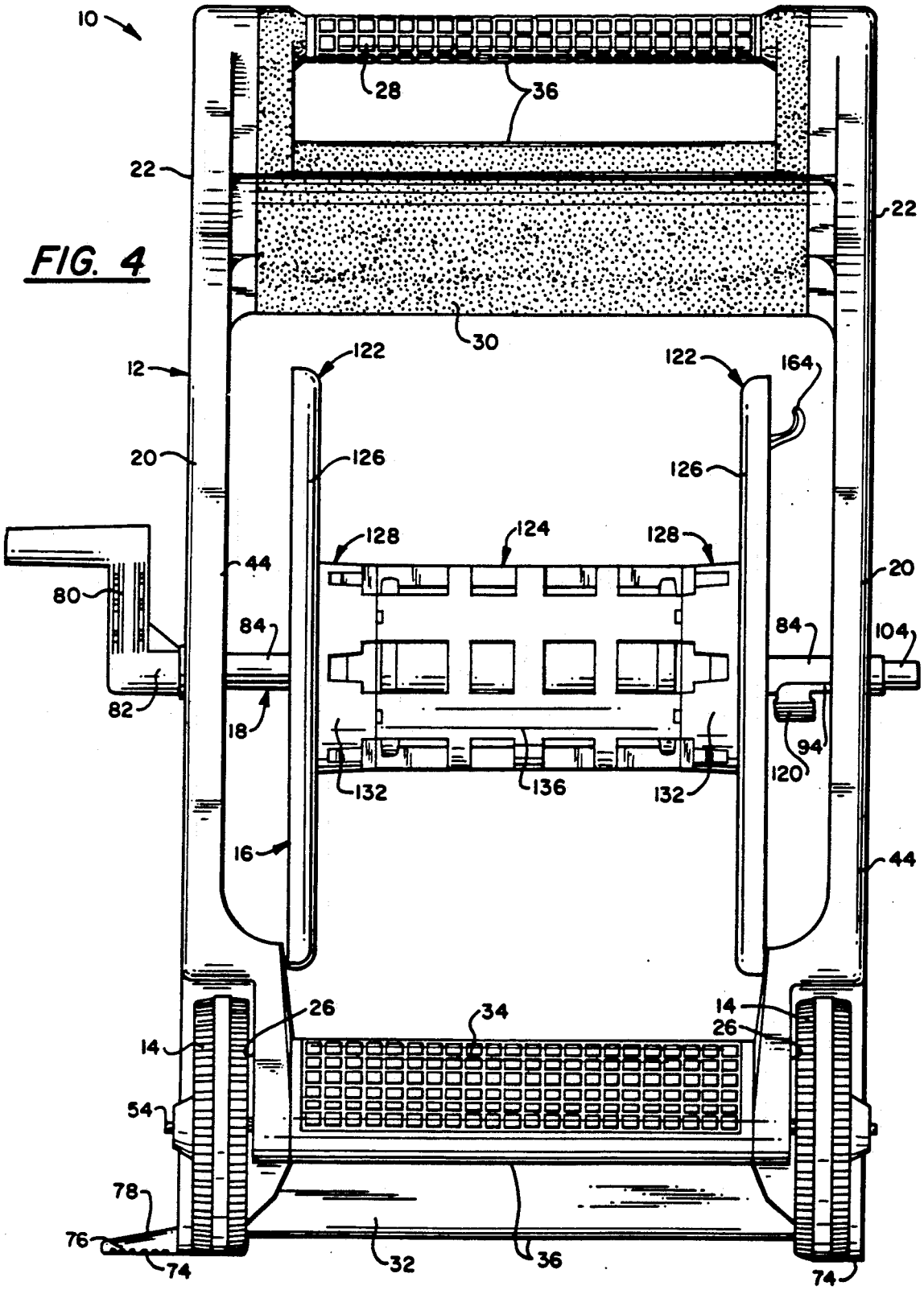
FIG. 4 is a rear elevational view of the portable hose reel assembly.
Figure 7:
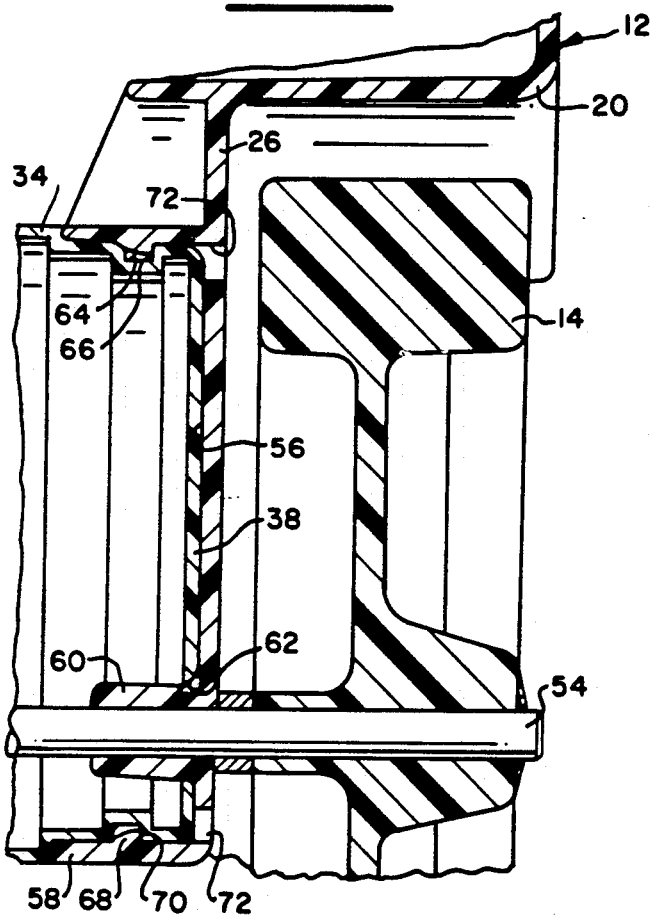
FIG. 7 is an enlarged fragmentary sectional view taken along the line 7—7 of FIG. 2.

As best shown in FIGS. 1, 4, and 7, the third corner structures 26 are transversely offset in a direction toward one another so as to form recesses within which the supporting wheels 14 are rotatably mounted on the ends of a shaft 54. The wheels are retained on the shaft 54 by suitable end caps 55 of the push-on self-retained type, as is best shown in FIG. 7. Each third corner structure 26 includes the juncture between the lower rearward elongated frame portions 42 and 44 and a third socket 56 shaped to snugly fit and receive a closed end portion 38 of the third transverse frame member 34. Each socket is defined by a peripheral wall 58 extending from an end wall forming a continuation of the crown of the channel configuration of the associated elongated frame portions. As best shown in FIG. 7, the end wall of the third corner structure 26 is formed with a cylindrical boss 60 through which the shaft 54 extends and is rotatably mounted. The closed end portion 38 of the third transverse frame member 34 has a corresponding opening 62 formed therein to receive the cylindrical boss 60 when the end portion 38 is engaged or snugly received within the third socket 36.

In accordance with the principles of the present invention, any suitable means may be provided for fixedly securing the end portions 38 within the associated sockets. Preferably, such means is integrally formed as interengaging elements on the end portions and sockets capable of effecting the fixed securement in response to the movement of the end portion into the socket. Various means are known and within the contemplation of the present invention. A preferred arrangement which is known per se is illustrated in the drawings as including an annular groove 64 formed in the periphery of each end portion 38 so as to define an annular locking surface 66 facing in a direction outwardly of the associated socket. The joint per se is embodied in the Crub Service Refuse Cart sold by Sears, Roebuck and Co. The socket portion is embodied in a downwardly facing cap structure and the interengaging element is formed on the upper end of a vertical frame member. Formed on the interior of the peripheral wall 58 of each socket is a pair of spaced locking tabs 68 each having a locking surface 70 facing inwardly of the associated socket and an inclined cam surface facing outwardly with respect thereto. In order to mold the locking tabs 68 integral with the peripheral wall, die pin receiving openings 72 are formed in the associated end wall of each socket.

With this construction, it can be seen that, as each end portion 38 is moved inwardly within the associated socket, the areas of the end portion contacted by the locking tabs 68 will be initially deflected inwardly by the cam surfaces until the locking tabs enter the associated annular grooves 64 at which time the locking surfaces 70 of the locking tabs will interengage the annular locking surface 66 of the associated end portion to retain the same within the socket and prevent a transverse movement outwardly of the socket.

As best shown in FIG. 2, the second corner structures 24 and the associated lower elongated frame portions 42 have downwardly facing surfaces 74 which are adapted to engage a generally horizontally extending surface on which the supporting wheels 14 are engaged for stably fixedly supporting the hose reel supporting frame structure 12 on the generally horizontally extending surface. In order to provide additional manually selective stabilization, an elongated horizontally extending platform portion 76 is formed integrally along the bottom of the right hand side frame 20. The platform portion 76 provides an upper surface 78 which can be stepped on by the user to further aid in stabilizing the aforesaid position of the hose reel supporting frame structure 12.

It will be noted that the central portion 36 of the upper first transverse frame member 28 is configured to provide a transversely elongated generally cylindrically shaped handle to be engaged manually by the user to facilitate the wheeled movement of the hose reel supporting frame structure 12 along the ground. Such movement is best accomplished by tilting the handle rearwardly so that the surfaces 74 are disposed out of ground engagement.

It will be noted that the shaft assembly 18 which serves to rotatably mount the hose reel structure 16 on the hose reel supporting frame structure 12 includes a hand crank 80 which extends from the right hand side frame 20 in a position to be manually engaged by the user while the foot of the user is engaged on the platform portion 76. In this way, the frame structure 12 is manually stabilized during the manual winding-up of a hose on the hose reel structure 16.

Figure 8:
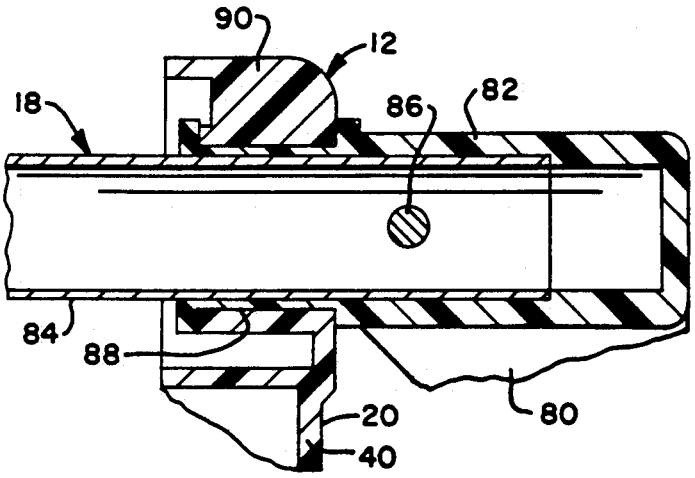
FIG. 8 is an enlarged fragmentary sectional view taken along the line 8—8 of FIG. 2.

As best shown in FIG. 8, the hand crank 80 includes a central hollow tubular portion 82 within which an end of a hollow rotatable shaft 84 forming a part of the shaft assembly 18 is fixedly mounted as by a fastener 86. The inner end of the hollow tubular portion 82 is exteriorly flanged to define an exterior bearing surface 88. This bearing surface 88 engages a semi-cylindrical surface provided in the central portion of the associated forward elongated frame portion 40 and a semi-cylindrical surface formed on a fitting 90 fixed as by threaded elements 92 within a recess in the center of the forward elongated frame portion 40.

Figure 9:
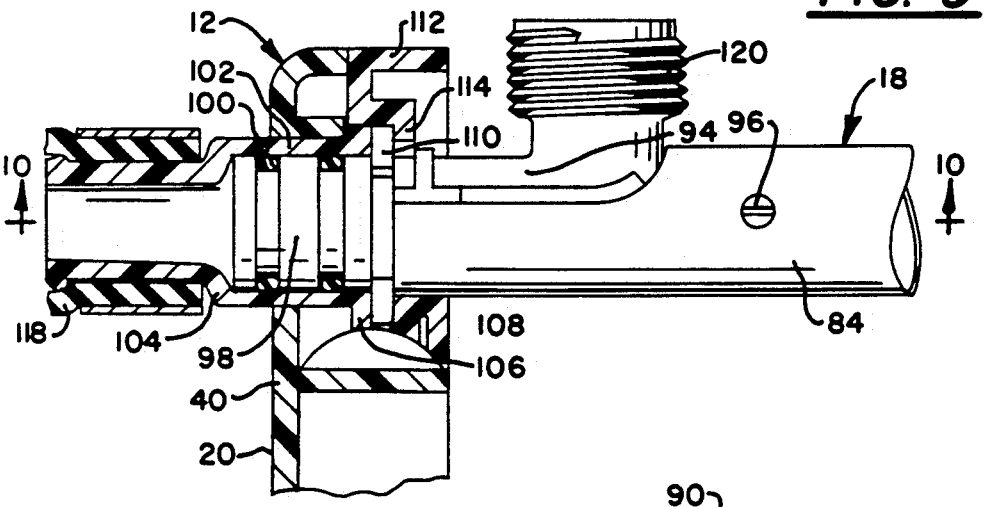
FIG. 9 is an enlarged sectional view taken along the line 8—8 at the opposite side of the assembly.

As best shown in FIG. 9, the hollow shaft 84 extends transversely from the right hand side frame 20 to the opposite left hand side frame 20 and is formed with a cut-out within which is received an elbow fitting 94. The elbow fitting 94 is fixedly secured within the adjacent end of the hollow shaft, as by a threaded element 96. The elbow fitting 94 includes an axial leg 98 which extends axially from the end of the hollow shaft 84. The axial leg 98 is grooved in its exterior periphery to receive a pair of O-ring seals 100 which serve to peripherally seal the rotational mount of the axial leg 98 of the elbow fitting 94 within a bearing portion 102 of a fixed hollow tubular shaft section 104 forming a part of the shaft assembly 18.

Figure 10:
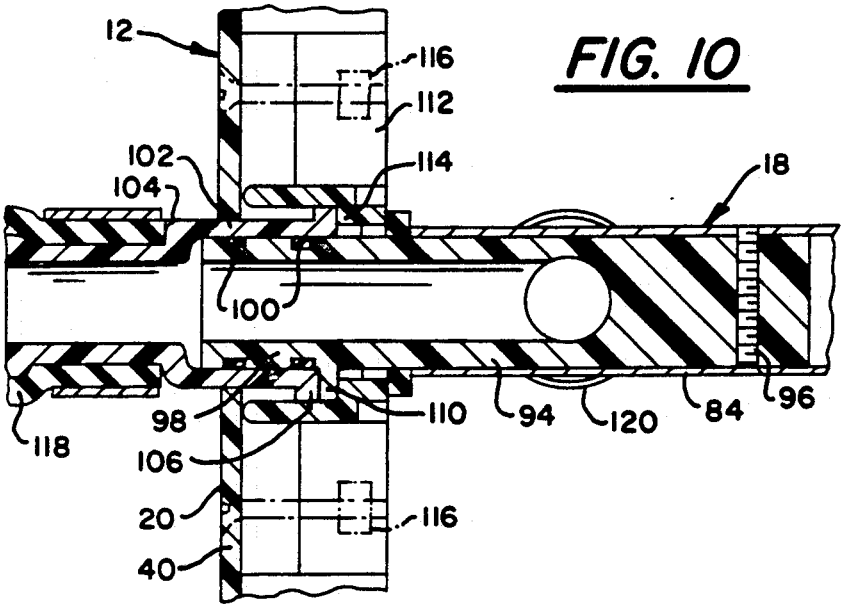
FIG. 10 is a sectional view taken along the line 10—10 of FIG. 9.

The fixed shaft section is exterior shaped to extend through a non-circular opening formed in the center of the associated forward elongated frame portion 40. Formed on the exterior of the bearing portion 102 is an annular flange 106 and an axially inwardly extending depending portion of the fixed shaft section provides a spaced arcuate flange 108 of an angular extent of approximately 60°. The axial leg 98 of the elbow fitting 94 has a flange 110 formed on the exterior thereof which has an annular extent sufficiently less than 360° so as to permit the same to be moved forwardly past the arcuate flange 108 into engagement with the annular flange 106 to permit a turning movement thereof between the annular flange 106 and the arcuate flange 108. To further aid in rotatably securing the elbow fitting 94 within the fixed shaft section 104 there is provided a fitting 112 which includes a U-shaped flange 114 extending over the flange 110 of the fitting 94 and the depending extension thereof so as to insure that in any position of rotation the flange 110 is prevented from axial movement in both directions. The fitting includes lateral extensions which are formed to receive bolt assemblies 116 extending therethrough and through the adjacent portion of the forward elongated frame portion 40 as shown in phantom lines in FIG. 10.

The fixed hollow shaft section 104 extends axially outwardly beyond the adjacent forward frame portion 40 and has its exterior periphery configured to receive the end of a hose section 118 the opposite end of which (not shown) is provided with a female fitting for securement to a source of water under pressure. Water under pressure thus is communicated with the interior of the shaft section 104 which in turn sealingly communicates with the interior of the axial leg of the elbow fitting 94. The elbow fitting 94 also includes a radial leg 120 which is exteriorly threaded to receive the female fitting of a hose length to be wound on the hose reel structure 16.

Figure 11:
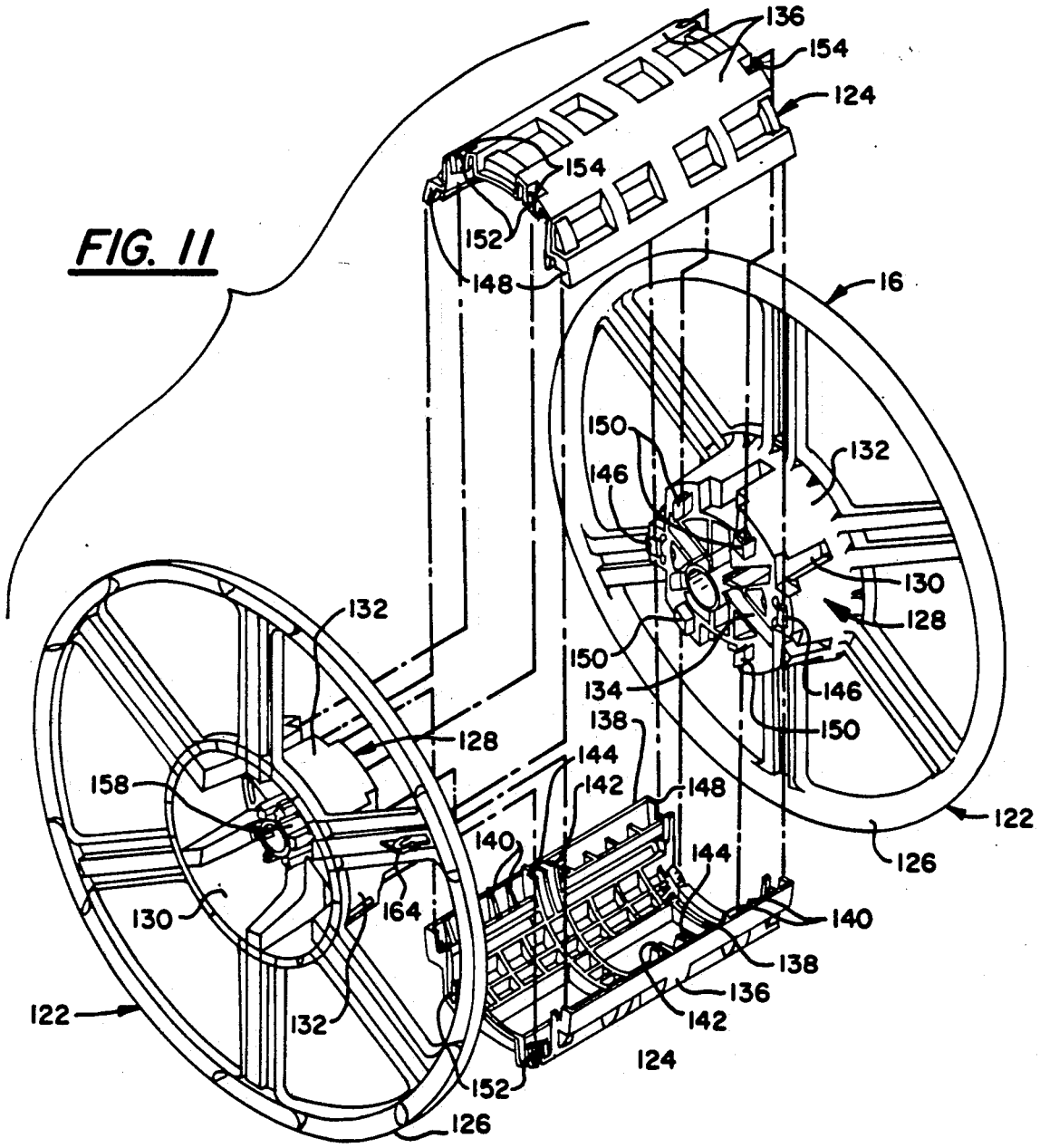
FIG. 11 is an exploded perspective view of the parts forming the hose reel structure.

Referring now more particularly to FIG. 11, the hose reel structure 16 is illustrated therein as consisting essentially of an assembly of four components including first and second reel end structures, generally indicated at 122, and two hub parts, generally indicated at 124. The reel end structures 122 are of similar construction bearing a mirror image relationship with one another and the two hub parts 124 are of similar construction. As shown, each reel end structure 122 includes a skeletonized or spoked annular end portion 126 defining a central axis which constitutes the rotational axis of the hose reel structure 16. Extending axially from an inner annulus of each end portion 126 is a fixed integral hub portion, generally indicated at 128. As shown, each reel end structure 126 is preferably molded of plastic material. To this end, the construction is thinwalled and channeled to provide strength. Each hub portion 128 includes a channeled peripheral wall 130 providing exterior hose engaging surfaces 132 and a channelized end wall 134 extending radially inwardly from the axially inwardly extending end of the peripheral wall 130. As shown, with the mirror image relationship between the two reel end structures 122, the hub portions 128 extend axially toward one another.

The two hub parts 124 cooperate together to form an annular hub section. It is within the contemplation of the present invention that the annular hub section could be formed by more than two hub parts. Two hub parts are preferable since they minimize the number of parts necessary. The hub parts 124 are also molded of an appropriate plastic material to provide a thin wall construction having both channels and interior ribs to lend strength to the thin walled bodies. Similarly, each of the two hub parts 124 are of generally hollow semi-cylindrical configuration so that when disposed together to form the annular hub section they provide exterior peripheral hose engaging surfaces 136.

Preferably, the end walls 134 of the hose reel end structures 122 and the ends of the hub parts 124 are provided with interengaging elements which serve to secure the four component parts into a fixed relatively rigid hose reel structure 16. Preferably, the interengaging elements are molded integrally with the respective molded components of the hose reel structure and are operative to effect the fixed securement in response to the movement of the components into cooperating relation within an operative position. To effect movement of the components into operative position, the two reel end structures 122 are retained in aligned spaced relation wherein the central axis of both are on a common axis. The assembled relationship is completed by moving the hub parts 124 from positions such as illustrated in FIG. 11 radially inwardly toward one another until they are in interengagement. In this regard, it will be noted that each hub part 124 includes annularly spaced axially extending edges 138 defining the annular extent of the exterior hose engaging surfaces 136. The edges are defined by radially extending edge surfaces which are disposed in interengagement when in operative position so as to transmit circumferential loads imparted thereto by a pressurized hose encircling the hose engaging surfaces 136. In order to prevent lateral shifting movement of the abutting edge surfaces 138, there are provided along a one-half section of each edge surface a plurality of fingers 140. When each pair of edge surfaces are in interengagement, the fingers 140 of each hub part extend beyond the cooperating abutting edge of the other hub part so that there is a positive stop provided against movement in either radial direction. In addition, there are three central ribs provided adjacent the central area of the edges 138 one outer one of which includes a tongue portion 142 and the complementary other outer one of which includes a tongue-receiving groove 144. These tongue-in-groove interengagements serve to further stabilize the central portion of the edges 138 against radial movement in either direction.

The fixed securement of each end of each hub part 124 with the end wall 134 of the associated reel end structure 122 is accomplished by providing a pair of diametrically opposed radially outwardly opening lug elements 146 on each of the hub end walls 134. The adjacent end of each hub part 124 includes an inwardly extending edge portion 148 adjacent the associated end of each edge 138 which, when the associated hub part 124 is moved into operative position, engage within the lugs 146 as shown in FIG. 13. This interengagement prevents relative axial movement between each hub part 124 and the associated reel end structure 122.

In addition, each end wall 134 is provided with a pair of spaced axially extending sockets 150. Each socket 150 is defined by a bottom wall and three side wall extending axially inwardly from the associated end wall 134 so as to be open in a radially outward direction and in an axially outward direction. Formed along each arcuate edge 138 of each hub part 124 is a pair of cooperating deflectable tabs 152. These tabs 152 are of generally V-shaped configuration and include deflectable free ends which have locking surfaces 154 on the extremity thereof facing radially outwardly. As can be seen from FIG. 12, when each hub part 124 is moved radially inwardly with respect to the associated reel end structure 122, the associated pair of deflectable tabs 152 enter the associated pair of sockets 150 and the deflectable tabs 152 are deflected axially until the locking surfaces 154 thereof engage beneath oppositely facing locking surfaces 156 adjacent the associated sockets 150. The interengagement between the locking surfaces 154 of the deflectable tabs 152 and the locking surfaces 156 of the associated reel end structures 122 prevents radial movement of the hub parts 124 in a radially outward direction with respect to the reel end structures, thus fixedly maintaining the four component parts in a generally rigid hose reel structure 16. It will be noted from FIG. 12 that lateral axial access is provided to the deflectable tabs to permit disassembly if necessary.

The hose reel structure 16 can be fixedly secured to the rotating hollow shaft 84 by any suitable means. A preferred arrangement is illustrated in FIG. 13. Specifically, each end wall 134 is molded with a hub portion 158 having diametrically opposed radially extending openings 160 each of which is formed in communicating relation to the radially outward extent of the hub portion 158. As best shown in FIG. 13, a bolt assembly 162 extends through the openings 160 in each hub portion 158 and through suitable radial openings extending through the hollow shaft. Such bolt assembly 162 includes a nut threadedly engaged on the end of a bolt assembly to effect the final rigid securement.

As best shown in FIGS. 4 and 11, the left hand end portion of the reel end structure 122 is formed with an integral hook 164. This hook 164 is used to secure the end portion of the hose in adjacent relation laterally outwardly of the left hand end portion 126 so as to enable non-interfering rotation of the reel to take place with the end portion of the hose outwardly of the adjacent reel end portion 126.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A portable hose reel assembly comprising a pair of molded plastic side frames each of similar generally triangular shaped configuration providing three corner structures, said side frames being disposed in transversely spaced parallel relation with corresponding corner structures facing one another, a first of said three corner structures of each side frame having first socket means therein opening in a direction toward the corresponding corner structure, a second of said three corner structures of each side frame having second socket means therein opening in a direction toward the corresponding corner structure, transverse frame members each formed of plastic by blow molding so as to define an elongated hollow tubular central portion having closed end portions on opposite ends of said central portion, the closed end portions of said transverse frame members being shaped to respectively fit snugly within said first and second socket means, each closed end portion and the associated socket means having interengaging surface means operable in response to the transverse movement of the closed end portion into the associated socket means to retain the closed end portion against transverse movement out of the associated socket means so that when all of said closed end portions are retained in snugly fitting relation with the associated socket means said transverse frame members and said side frames constitute a hose reel supporting frame structure, a third of said three corner structures of said side frames having aligned shaft receiving openings therein, a shaft extending through said shaft receiving openings, supporting wheels on said shaft for enabling the hose reel supporting frame structure to be rollingly supported for manual movement along a generally horizontally extending surface by an operator grasping a central portion of a transverse frame member associated with said first socket means, means on said second corner structures for engaging a generally horizontally extending surface on which said supporting wheel are engaged for stably fixedly supporting said hose reel supporting frame structure on said generally horizontally extending surface, a hose reel structure for receiving a length of hose in coiled formation thereon, and means for rotatably supporting said hose reel structure between said side frames in a position such that said hose reel structure is disposed above a generally horizontally extending surface on which said hose reel supporting frame structure is manually moved or stably fixedly supported as aforesaid.

2. A portable hose reel assembly as defined in claim 1 wherein said third corner structures are transversely offset in a direction toward one another so as to form recesses within which said supporting wheels are rotatably mounted on the ends of said shaft.

3. A portable hose reel assembly as defined in claim 2 wherein said hose reel supporting frame structure includes a third corner transverse frame member fixed between the recessed third corner structures in parallel coextensive relation with a central portion of the shaft extending between said third corner structures.

4. A portable hose reel assembly as defined in claim 3 wherein said third corner transverse frame member is formed of plastic by blow molding so as to define an elongated hollow tubular central portion having closed end portions on opposite ends of said central portion, each third corner structure having third socket means therein opening in a direction toward the corresponding third corner structure, the closed ends of said third corner transverse frame member being shaped to snugly fit within said third socket means and having apertures formed therein through which said shaft extends, each closed end of said third corner transverse frame member and the associated third socket means having interengaging surface means operable in response to the transverse movement of each closed end portion of said third corner transverse frame member into the associated third socket means to retain each closed end portion against transverse movement out of the associated third socket means.

5. A portable hose reel assembly as defined in claim 4 wherein the interengaging means associated with each closed end portion comprises an annular groove formed in said closed end portion in spaced relation to an end wall thereof, each annular groove defining a locking surface facing away from the associated end wall, said first, second and third socket means having spaced locking tabs extending therein in a direction transverse to the transverse direction of movement of the associated end portion therein, each tab including a locking surface positioned and facing in a direction to interengage with the locking surface defined by the annular groove of the associated end portion when snugly fitted within the associated socket means.

6. A portable hose reel assembly as defined in claim 5 wherein each socket means includes a socket defined by a peripheral wall having at least two tabs formed integrally thereon and an end wall closing an outer end of said peripheral wall, each socket defining end wall having openings disposed in parallel coextensive relation within the locking surfaces of the tabs on the associated peripheral wall.

7. A portable hose reel assembly as defined in claim 6 wherein each side frame is formed by a forward elongated frame portion extending downwardly and forwardly from said first corner structure to said second corner structure when said hose reel supporting frame structure is stably fixedly supported on said generally horizontally extending surface, a lower elongated frame portion extending generally horizontally rearwardly from said second corner structure to said third corner structure, a rearward elongated frame portion extending generally vertically upwardly from said third corner structure to said first corner structure and an elongated diagonal frame portion extending generally downwardly and rearwardly from said forward frame portion to said rearward frame structure.

8. A portable hose reel assembly as defined in claim 7 wherein each of said elongated frame portions is of channel configuration opening in a direction toward the opposite side frame with integral ribs formed within the channel configuration.

9. A portable hose reel assembly as defined in claim 8 wherein each first socket means includes adjacent upper and lower sockets, said transverse frame members including upper and lower transverse frame members associated with said upper and lower sockets respectively, the central portion of said upper transverse frame member being shaped to provide a manually engageable transversely extending handle spaced from the central portion of said lower transverse frame member.

10. A portable hose reel assembly as defined in claim 9 wherein each first corner structure includes a juncture between the associated forward and rearward elongated frame portion defining the associated lower socket and an upward and rearward extension defining the associated upper socket.

11. A portable hose reel assembly as defined in claim 1 wherein said hose reel supporting frame structure includes a third corner transverse frame member fixed between the recessed third corner structures in parallel coextensive relation with a central portion of the shaft extending between said third corner structures.

12. A portable hose reel assembly as defined in claim 11 wherein said third corner transverse frame member is formed of plastic by blow molding so as to define an elongated hollow tubular central portion having closed end portions on opposite ends of said central portion, each third corner structure having third socket means therein opening in a direction toward the corresponding third corner structure, the closed ends of said third corner transverse frame member being shaped to snugly fit within said third socket means and having apertures formed therein through which said shaft extends, each closed end of said third corner transverse frame member and the associated third socket means having interengaging surface means operable in response to the transverse movement of each closed end portion of said third corner transverse frame member into the associated third socket means to retain each closed end portion against transverse movement out of the associated third socket means.

13. A portable hose reel assembly as defined in claim 1 wherein the interengaging means associated with each closed end portion comprises an annular groove formed in said closed end portion in spaced relation to an end wall thereof, each annular groove defining a locking surface facing away from the associated end wall, said first, second and third socket means having spaced locking tabs extending therein in a direction transverse to the transverse direction of movement of the associated end portion therein, each tab including a locking surface positioned and facing in a direction to interengage with the locking surface defined by the annular groove of the associated end portion when snugly fitted within the associated socket means.

14. A portable hose reel assembly as defined in claim 13 wherein each socket means includes a socket defined by a peripheral wall having at least two tabs formed integrally thereon and an end wall closing an outer end of said peripheral wall, each socket defining end wall having openings disposed in parallel coextensive relation within the locking surfaces of the tabs on the associated peripheral wall.

15. A portable hose reel assembly as defined in claim 1 wherein each side frame is formed by a forward elongated frame portion extending downwardly and forwardly from said first corner structure to said second corner structure when said hose reel supporting frame structure is stably fixedly supported on said generally horizontally extending surface, a lower elongated frame portion extending generally horizontally rearwardly from said second corner structure to said third corner structure, a rearward elongated frame portion extending generally vertically upwardly from said third corner structure to said first corner structure and an elongated diagonal frame portion extending generally downwardly and rearwardly from said forward frame portion to said rearward frame structure.

16. A portable hose reel assembly as defined in claim 15 wherein each of said elongated frame portions is of channel configuration opening in a direction toward the opposite side frame with integral ribs formed within the channel configuration.

17. A portable hose reel assembly as defined in claim 1 wherein each first socket means includes adjacent upper and lower sockets, said transverse frame members including upper and lower transverse frame members associated with said upper and lower sockets respectively, the central portion of said upper transverse frame member being shaped to provide a manually engageable transversely extending handle spaced from the central portion of said lower transverse frame member.

18. A portable hose reel assembly as defined in claim 17 wherein each side frame is formed by a forward elongated frame portion extending downwardly and forwardly from said first corner structure to said second corner structure when said hose reel supporting frame structure is stably fixedly supported on said generally horizontally extending surface, a lower elongated frame portion extending generally horizontally rearwardly from said second corner structure to said third corner structure, a rearward elongated frame portion extending generally vertically upwardly from said third corner structure to said first corner structure and an elongated diagonal frame portion extending generally downwardly and rearwardly from said forward frame portion to said rearward frame structure.

19. A portable hose reel assembly as defined in claim 18 wherein each first corner structure includes a juncture between the associated forward and rearward elongated frame portion defining the associated lower socket and an upward and rearward extension defining the associated upper socket.

20. A portable hose reel assembly as defined in claim 1 wherein said hose reel structure comprises a first reel end structure having a central axis and a fixed first hub portion extending axially therefrom, a second reel end structure having a central axis aligned with the axis of said first reel end, said second reel end structure having a fixed second hub portion extending axially therefrom in a direction toward said first hub portion in axially aligned and axially spaced relation thereto, a plurality of cooperating hub parts, each having axially spaced first and second end portions, cooperating means on the first and second end portions of said hub parts and on the first and second hub portions of said first and second reel end structures for enabling each hub part to be secured in an operative position in fixed relation between said hub portions in response to a generally radially inward movement of the hub parts with respect to the hub portions of the reel end structures, said hub portions having axially extending exterior hose engaging surfaces, said hub parts when in their operative positions with respect to said hub portions providing axially extending exterior hose engaging surfaces extending between the exterior hose engaging surfaces of said hub portions between said reel end structures around which a length of hose can be coiled between said reel end structures, said hub parts having interengaging surfaces disposed in compressive hose coil load transmitting relation with respect to one another when said hub parts are in their operative position.

21. A hose reel assembly as defined in claim 1 wherein the side frame associated with said hand crank means includes a platform frame portion extending between the second and third corner structures thereof in laterally outwardly extending relation, said horizontally extending surface engaging means including lower surface means on said platform frame portion, said platform frame portion having upper surface means for enabling a user to step on said platform frame portion to stabilize said hose reel supporting frame structure during the winding up of a hose on said hose handling reel by manually turning said hand crank means.

22. A hose reel assembly as defined in claim 21 wherein said shaft assembly includes a fixed tubular shaft section defining the second end portion of said shaft assembly fixed to said frame assembly in axially outwardly extending relation thereof, said bearing means including an interior bearing surface provided by said tubular shaft section, an elbow fitting fixed to said rotatable shaft section having an axial leg sealingly rotatably mounted in said bearing surface in fluid communicating relation with the interior of said tubular shaft section and a radial leg extending radially outwardly for connection with a water receiving end of a hose and means connected with said tubular shaft section axially outwardly of said frame structure for communicating the interior of said tubular shaft section with a source of water under pressure.

23. A hose reel assembly comprising a first reel end structure having a central axis and a fixed first hub portion extending axially therefrom, a second reel end structure having a central axis aligned with the axis of said first reel end, said second reel end structure having a fixed second hub portion extending axially therefrom in a direction toward said first hub portion in axially aligned and axially spaced relation thereto, a plurality of cooperating hub parts, each having axially spaced first and second end portions, cooperating means on the first and second end portions of said hub parts and on the first and second hub portions of said first and second reel end structures for enabling each hub part to be secured in an operative position in fixed relation between said hub portions in response to a generally radially inward movement of the hub part with respect to the hub portions of the reel end structures so as to form a generally rigid hose reel structure, said hub portions having axially extending exterior hose engaging surfaces, said hub parts when in their operative positions with respect to said hub portions providing axially extending exterior hose engaging surfaces extending between the exterior hose engaging surfaces of said hub portions between said reel end structures around which a length of hose can be coiled between said reel end structures, said hub parts having interengaging surfaces disposed in compressive hose coil load transmitting relation with respect to one another when said hub parts are in their operative positions.

24. A hose reel assembly as defined in claim 23 wherein each of said reel end structures includes an annular skeletonized end portion extending generally radially outwardly from the associated hub portion, each hub portion including a peripheral wall integrally joined with said annular end portion at an axial end thereof and having an end wall extending generally radially inwardly from an opposite axial end thereof.

25. A hose reel assembly as defined in claim 24 wherein said plurality of hub parts consists of two semi-annular hub parts movable in generally opposed radially inward directions into said operative position, each of said semi-annular hub parts having annularly spaced axially extending edges defining the annular extent of said exterior hose engaging surfaces.

26. A hose reel assembly as defined in claim 25 wherein said interengaging surfaces include edge surfaces extending along the axially extending edges of said semi-annular hub parts and facing in the opposed directions of generally radially inward movements thereof when said hub parts are moved so as to interengage into said operative position and to prevent further generally radially inward movements of said hub parts in said opposed directions and abutment surfaces facing in opposed directions extending transverse to said edge surfaces so as to interengage when said hub parts are moved into said operative position and prevent transverse movement between the interengaging edge surfaces.

27. A hose reel assembly as defined in claim 26 wherein said cooperating means comprises axially facing surfaces movable in response to said generally radially inward movement of said hub parts into opposed interengaging relation when said hub parts are in said operative position so as to prevent relative axial movement between said hub parts and said hub portions while said hub parts are in said operative position, deflectable tabs deflectable out of locking positions in response to said generally radial movement of said hub parts and movable into said locking positions when said hub parts are in said operative position, and locking surfaces for engaging said deflectable tabs when the latter are in said locking positions and said hub parts are in said operative position for preventing generally radially outward movement of said hub parts with respect to said hub portions.

28. A hose reel assembly as defined in claim 27 wherein said deflectable tabs are axially outwardly exposed to enable the same to be manually moved out of said locking positions by obtaining axially inward access thereto.

29. A hose reel assembly as defined in claim 28 wherein said rigid hose reel structure has a shaft assembly extending axially therethrough having first and second opposite end portions, a hose reel supporting frame structure supporting the first and second opposite end portions of said shaft assembly, bearing means operatively associated with said shaft assembly enabling said hose reel structure to be rotated about the aligned central axes of said reel end structures with respect to said three-dimensional frame structure.

30. A hose reel assembly as defined in claim 29 wherein said shaft assembly includes a rotating shaft section fixed to said rigid hose reel structure defining the first end portion of said shaft assembly, said bearing means including a first bearing carried by said hose reel supporting frame structure and rotatably supporting said first end portion in axially outwardly extending relation therewith, and hand crank means fixed to said first end portion in axially outwardly extending relation with respect to said frame structure.

31. A hose reel assembly as defined in claim 30 wherein said shaft assembly includes a fixed tubular shaft section defining the second end portion of said shaft assembly fixed to said frame assembly in axially outwardly extending relation thereof, said bearing means including an interior bearing surface provided by said tubular shaft section, an elbow fitting fixed to said rotatable shaft section having an axial leg sealingly rotatably mounted in said bearing surface in fluid communicating relation with the interior of said tubular shaft section and a radial leg extending radially outwardly for connection with a water receiving end of a hose and means connected with said tubular shaft section axially outwardly of said frame structure for communicating the interior of said tubular shaft section with a source of water under pressure.

32. A hose reel assembly as defined in claim 31 wherein said hose reel supporting frame structure comprises a pair of molded plastic side frames each of similar generally triangular shaped configuration providing three corner structures, said side frames being disposed in transversely spaced parallel relation with corresponding corner structures facing one another, a first of said three corner structures of each side frame having first socket means therein opening in a direction toward the corresponding corner structure, a second of said three corner structures of each side frame having second socket means therein opening in a direction toward the corresponding corner structure, a plurality of transverse frame members each formed of plastic by blow molding so as to define an elongated hollow tubular central portion having closed end portions on opposite ends of said central portion, the closed end portions of said transverse frame members being shaped to respectively fit snugly within said first and second socket means, each closed end portion and the associated socket means having interengaging surface means operable in response to the transverse movement of the closed end portion into the associated socket means to retain the closed end portion against transverse movement out of the associated socket means, a third of said three corner structures of said side frames having aligned shaft receiving openings therein, a shaft extending through said shaft receiving openings, supporting wheels on said shaft for enabling the hose reel supporting frame structure to be rollingly supported for manual movement along a generally horizontally extending surface by an operator grasping a central portion of a transverse frame member associated with said first socket means, and means on said second corner structures for engaging a generally horizontally extending surface on which said supporting wheels are engaged for stably fixedly supporting said hose engaging frame structure on said generally horizontally extending surface.

33. A hose reel assembly as defined in claim 23 wherein said plurality of hub parts consists of two semi-annular hub parts movable in generally opposed radially inward directions into said operative position, each of said semi-annular hub parts having annularly spaced axially extending edges defining the annular extent of said exterior hose engaging surfaces.

34. A hose reel assembly as defined in claim 25 wherein said interengaging surfaces include edge surfaces extending along the axially extending edges of said semi-annular hub parts and facing in the opposed directions of generally radially inward movements thereof when said hub parts are moved so as to interengage into said operative position and to prevent further generally radially inward movements of said hub parts in said opposed directions and abutment surfaces facing in opposed directions extending transverse to said edge surfaces so as to interengage when said hub parts are moved into said operative position and prevent transverse movement between the interengaging edge surfaces.

35. A hose reel assembly as defined in claim 23 wherein said cooperating means comprises axially facing surfaces movable in response to said generally radially inward movement of said hub parts into opposed interengaging relation when said hub parts are in said operative position so as to prevent relative axial movement between said hub parts and said hub portions while said hub parts are in said operative position, deflectable tabs deflectable out of locking positions in response to said generally radial movement of said hub parts and movable into said locking positions when said hub parts are in said operative position, and locking surfaces for engaging said deflectable tabs when the latter are in said locking positions and said hub parts are in said operative position for preventing generally radially outward movement of said hub parts with respect to said hub portions.

36. A hose reel assembly as defined in claim 35 wherein said deflectable tabs are axially outwardly exposed to enable the same to be manually moved out of said locking positions by obtaining axially inward access thereto.

37. A hose reel assembly as defined in claim 23 wherein said rigid hose reel structure has a shaft assembly extending axially therethrough having first and second opposite end portions, a hose reel supporting frame structure supporting the first and second opposite end portions of said shaft assembly, bearing means operatively associated with said shaft assembly enabling said hose reel structure to be rotated about the aligned central axes of said reel end structures with respect to said three-dimensional frame structure.

38. A hose reel assembly as defined in claim 37 wherein said shaft assembly includes a rotating shaft section fixed to said rigid hose reel structure defining the first end portion of said shaft assembly, said bearing means including a first bearing carried by said hose reel supporting frame structure and rotatably supporting said first end portion in axially outwardly extending relation therewith, and hand crank means fixed to said first end portion in axially outwardly extending relation with respect to said hose reel supporting frame structure.

39. A hose reel assembly as defined in claim 38 wherein said shaft assembly includes a fixed tubular shaft section defining the second end portion of said shaft assembly fixed to said frame assembly in axially outwardly extending relation thereof, said bearing means including an interior bearing surface provided by said tubular shaft section, an elbow fitting fixed to said rotatable shaft section having an axial leg sealingly rotatably mounted in said bearing surface in fluid communicating relation with the interior of said tubular shaft section and a radial leg extending radially outwardly for connection with a water receiving end of a hose and means connected with said tubular shaft section axially outwardly of said frame structure for communicating the interior of said tubular shaft section with a source of water under pressure.

40. A hose reel assembly as defined in claim 38 wherein said hose reel supporting frame structure comprises a pair of molded plastic side frames each of similar generally triangular shaped configuration providing three corner structures, said side frames being disposed in transversely spaced parallel relation with corresponding corner structures facing one another, a first of said three corner structures of each side frame having first socket means therein opening in a direction toward the corresponding corner structure, a second of said three corner structures of each side frame having second socket means therein opening in a direction toward the corresponding corner structure, a plurality of transverse frame members each formed of plastic by blow molding so as to define an elongated hollow tubular central portion having closed end portions on opposite ends of said central portion, the closed end portions of said transverse frame members being shaped to respectively fit snugly within said first and second socket means, each closed end portion and the associated socket means having interengaging surface means operable in response to the transverse movement of the closed end portion into the associated socket means to retain the closed end portion against transverse movement out of the associated socket means, a third of said three corner structures of said side frames having aligned shaft receiving openings therein, a shaft extending through said shaft receiving openings, supporting wheels on said shaft for enabling the hose reel supporting frame structure to be rollingly supported for manual movement along a generally horizontally extending surface by an operator grasping a central portion of a transverse frame member associated with said first socket means, and means on said second corner structures for engaging a generally horizontally extending surface on which said supporting wheels are engaged for stably fixedly supporting said hose engaging frame structure on said generally horizontally extending surface.

* * * * *